US008555425B2

(12) United States Patent
Keegan

(10) Patent No.: US 8,555,425 B2
(45) Date of Patent: Oct. 15, 2013

(54) AQUATIC GOGGLES

(75) Inventor: Steven Louis Keegan, Los Angeles, CA (US)

(73) Assignee: Nike, Inc., Beaverton, OR (US)

( * ) Notice: Subject to any disclaimer, the term of this patent is extended or adjusted under 35 U.S.C. 154(b) by 1325 days.

(21) Appl. No.: 12/116,362

(22) Filed: May 7, 2008

(65) Prior Publication Data

US 2009/0276941 A1 Nov. 12, 2009

(51) Int. Cl.
*A61F 9/02* (2006.01)

(52) U.S. Cl.
USPC ..... 2/440; 2/448

(58) Field of Classification Search
USPC ..... 2/426–428, 440, 446, 448–450; 351/43
See application file for complete search history.

(56) References Cited

U.S. PATENT DOCUMENTS

| | | | | |
|---|---|---|---|---|
| 2,007,431 | A * | 7/1935 | Malcom | 2/445 |
| 2,773,260 | A * | 12/1956 | Hirschmann | 2/441 |
| 4,286,340 | A | 9/1981 | Lathrop | |
| 5,313,671 | A | 5/1994 | Flory | |
| 5,331,691 | A | 7/1994 | Runckel | |
| 5,390,373 | A | 2/1995 | Flory | |
| 5,596,771 | A | 1/1997 | Hsu et al. | |
| 5,829,064 | A * | 11/1998 | Huang | 2/428 |
| 5,896,588 | A * | 4/1999 | Chiang | 2/428 |
| 5,956,778 | A * | 9/1999 | Godoy | 2/428 |
| 6,119,279 | A * | 9/2000 | Haslbeck | 2/445 |
| 6,560,788 | B1 * | 5/2003 | Beltrani | 2/428 |
| 6,880,177 | B2 * | 4/2005 | Sung | 2/440 |
| 2002/0170108 | A1 | 11/2002 | Chiang | |
| 2005/0268386 | A1 * | 12/2005 | Oishi et al. | 2/448 |
| 2006/0048288 | A1 * | 3/2006 | Haslbeck | 2/439 |
| 2006/0242745 | A1 | 11/2006 | DiChiara | |

FOREIGN PATENT DOCUMENTS

| | | |
|---|---|---|
| CN | 2439294 | 7/2001 |
| CN | 2543553 | 4/2003 |
| CN | 201308745 | 9/2009 |
| CN | 201308746 | 9/2009 |
| CN | 201308747 | 9/2009 |
| DE | 202004008927 | 9/2004 |
| EP | 0891788 | 1/1999 |

OTHER PUBLICATIONS

Notification of First Office Action and Search Report in Chinese Invention Patent Application No. 2008101752043, mailed on Aug. 17, 2012.

* cited by examiner

*Primary Examiner* — Katherine Moran
(74) *Attorney, Agent, or Firm* — Plumsea Law Group, LLC

(57) ABSTRACT

Aquatic goggles may incorporate a pair of eyepieces, a nosebridge extending between the eyepieces, and a headstrap. In some configurations, at least one of the eyepieces includes a lens, a gasket extending around the lens, and an extension member extending outward from the lens. The extension member defines a strap connection point, with a distance along the extension member and between the lens and the strap connection point being at least three centimeters, and the headstrap is secured to the strap connection point. In other configurations, a fairing extends outward from the lens, and a majority of the fairing may be located within an outer area of the lens. In further configurations, the gasket defines an indentation with varying depth.

31 Claims, 16 Drawing Sheets

AQUATIC GOGGLES

BACKGROUND

Aquatic goggles are generally used to isolate eyes of a swimmer from surrounding water and improve underwater vision. Conventional aquatic goggles include a pair of eyepieces, a nosebridge, and a headstrap. The eyepieces cover the eyes to prevent water from contacting the eyes during swimming or other aquatic activities. More particularly, the eyepieces extend over the eyes and contact the face to provide the swimmer with an eye-air interface, rather than exposing the eyes directly to the water. In addition to a lens formed from a transparent material, the eyepieces may include a gasket that extends around the lens to form a seal between the face (i.e., portions of the face surrounding the eyes) and the eyepieces, thereby preventing water from entering the eyepieces and obstructing vision. The nosebridge is joined to a side of each eyepiece and extends between the eyepieces and over a nose of the swimmer. In general, the nosebridge spaces the eyepieces from each other and may be adjustable to permit changes in the spacing distance between the eyepieces. The headstrap is joined to a side of each eyepiece opposite the nosebridge and extends around a head of the swimmer, and the headstrap is generally formed from an elastomer that stretches to hold the aquatic goggles against the head of the swimmer.

SUMMARY

Aquatic goggles may incorporate a pair of eyepieces, a nosebridge extending between the eyepieces, and a headstrap. In some configurations, at least one of the eyepieces includes a lens, a gasket extending around the lens, and an extension member extending outward from the lens. The extension member defines a strap connection point, with a distance along the extension member and between the lens and the strap connection point being at least three centimeters, and the headstrap is secured to the strap connection point. In other configurations, a fairing extends outward from the lens, and a majority of the fairing may be located within an outer area of the lens. In further configurations, the gasket defines an indentation with varying depth.

A method of manufacturing aquatic goggles may include forming a lens from a first material that is at least partially transparent. The lens is located within a mold. A second material is injected into the mold to form (a) a gasket that is bonded to the lens and extends around the lens and (b) an extension member extending outward from the lens. A headstrap is secured to the extension member at a position that is spaced from the lens.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
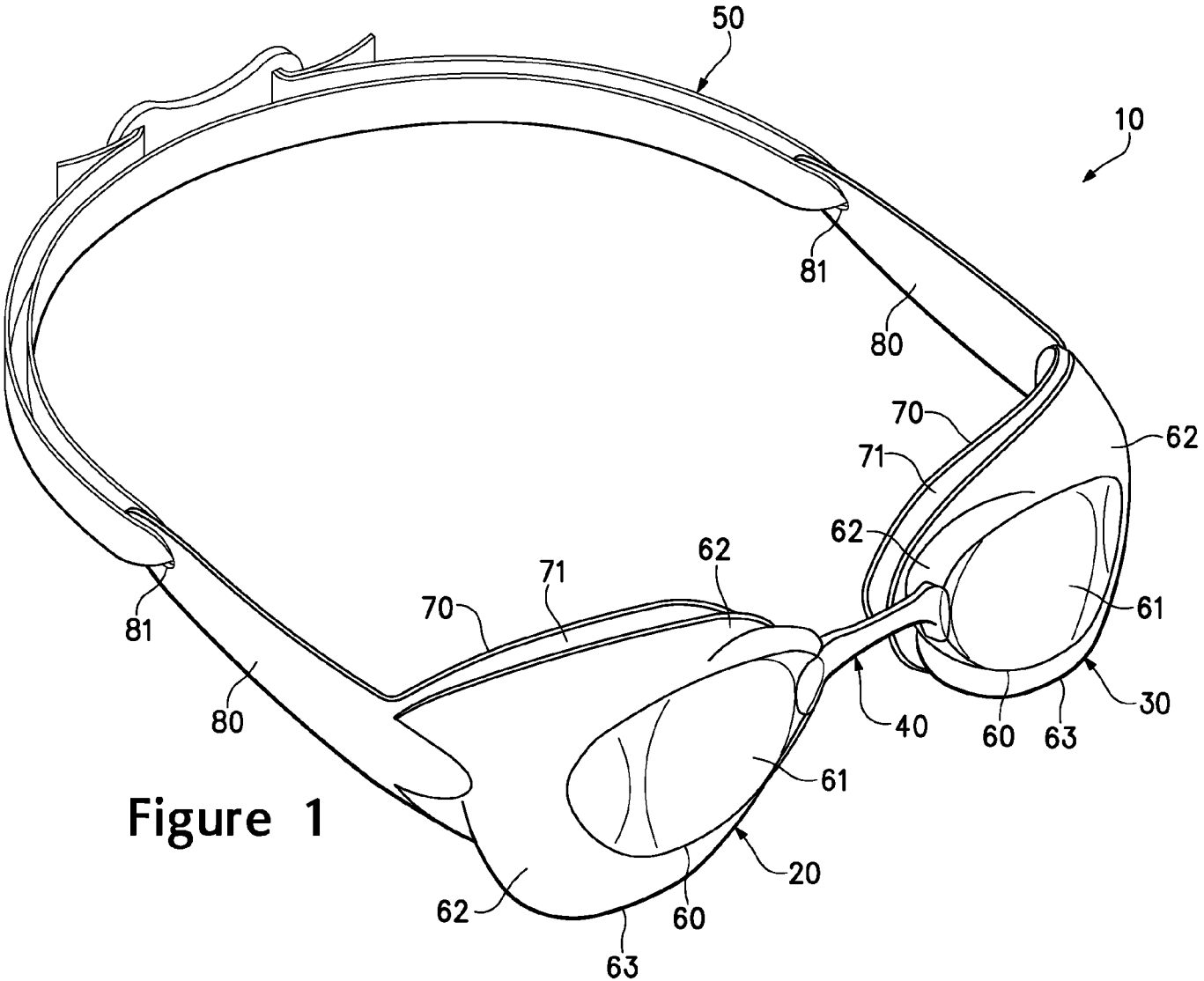
FIG. 1 is a perspective view of a pair of aquatic goggles.
Figure 2:
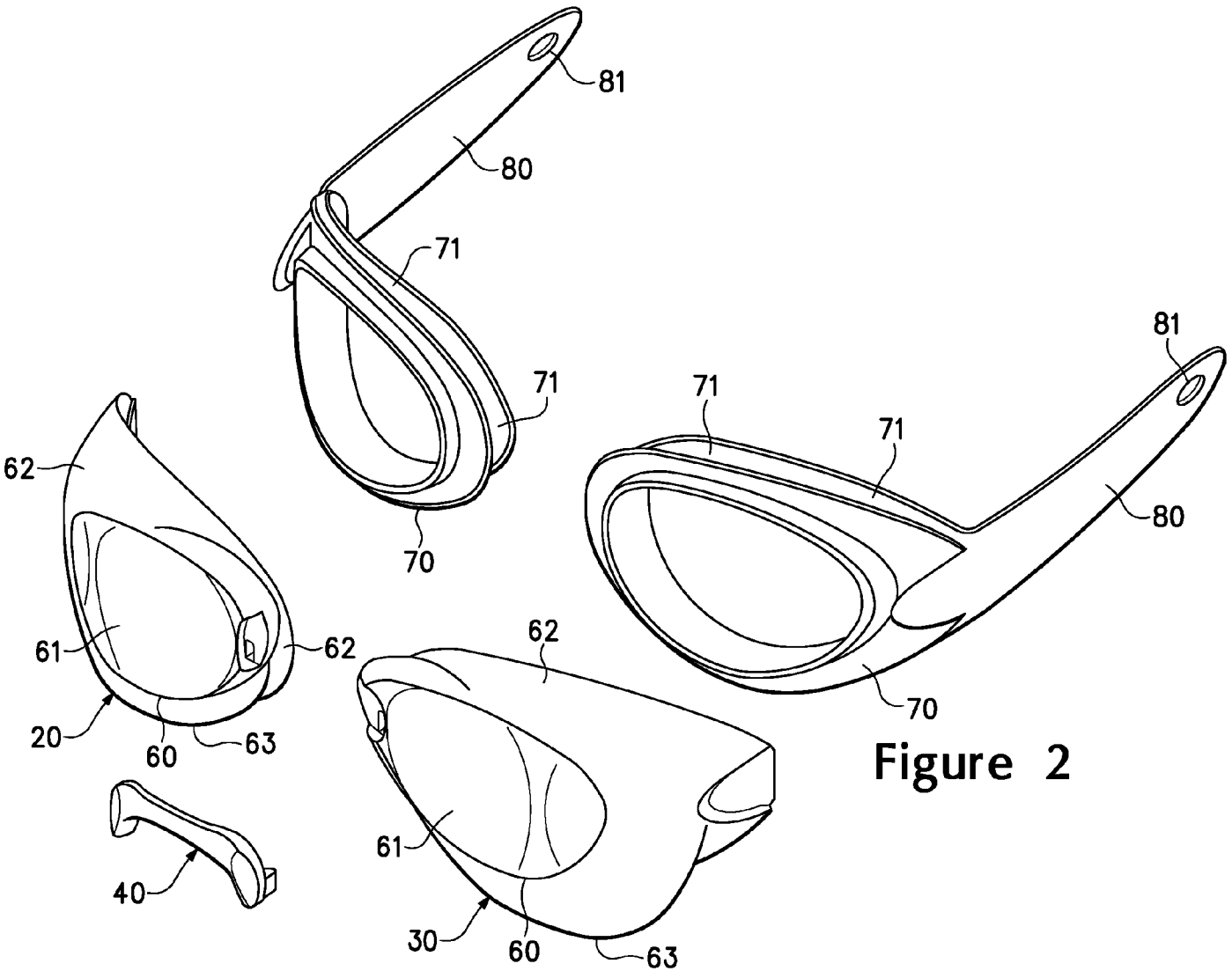
FIG. 2 is an exploded perspective view of the pair of aquatic goggles.
Figure 3:
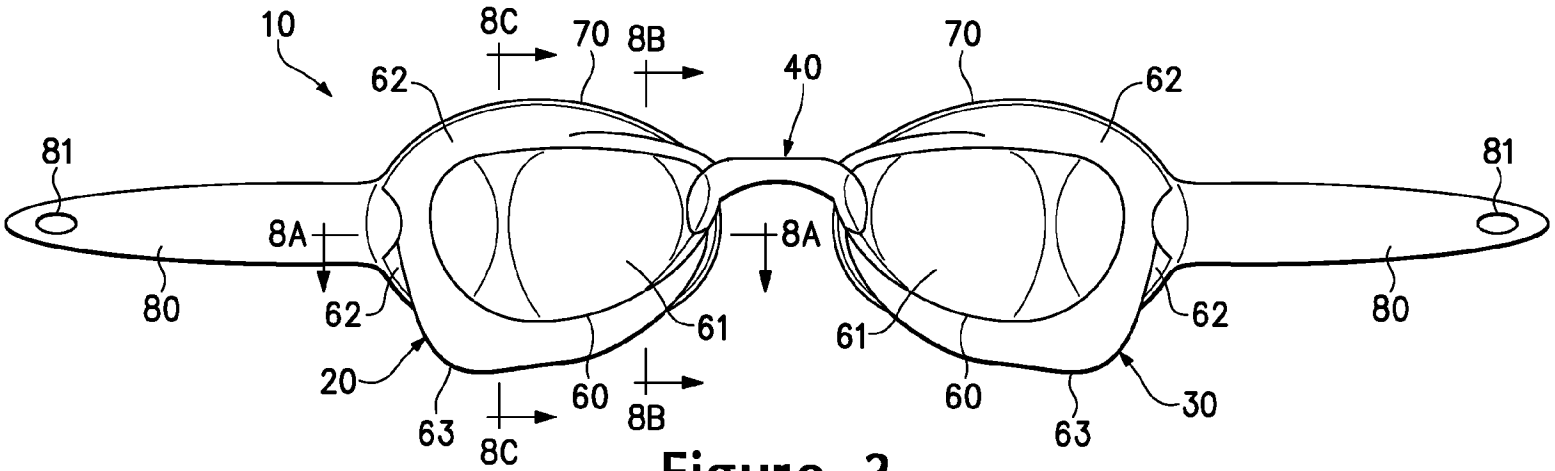
FIG. 3 is a front elevational view of the aquatic goggles.
Figure 4:
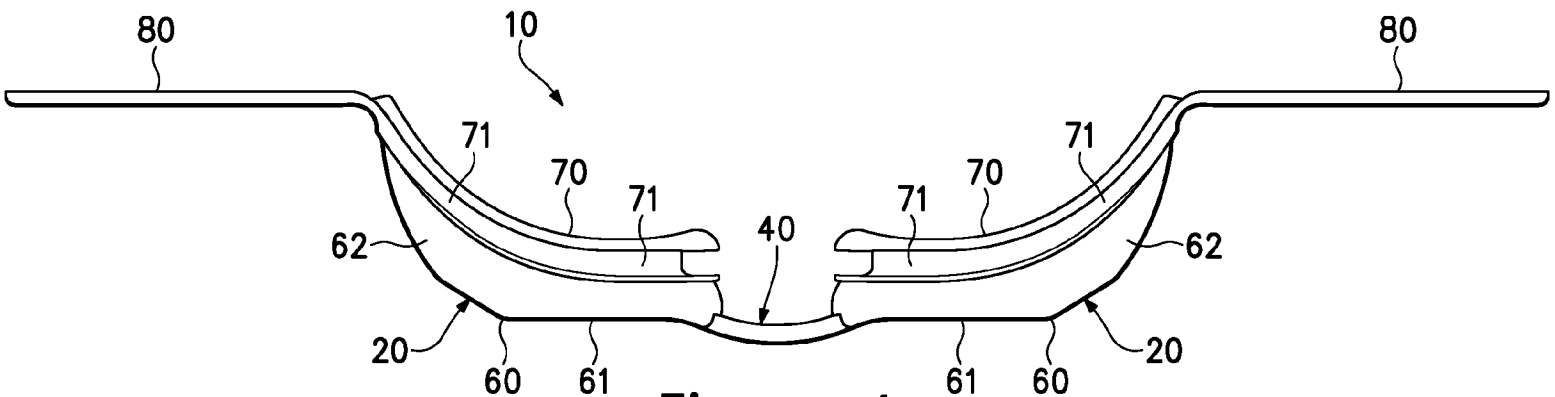
FIG. 4 is a top plan view of the aquatic goggles.
Figure 5:
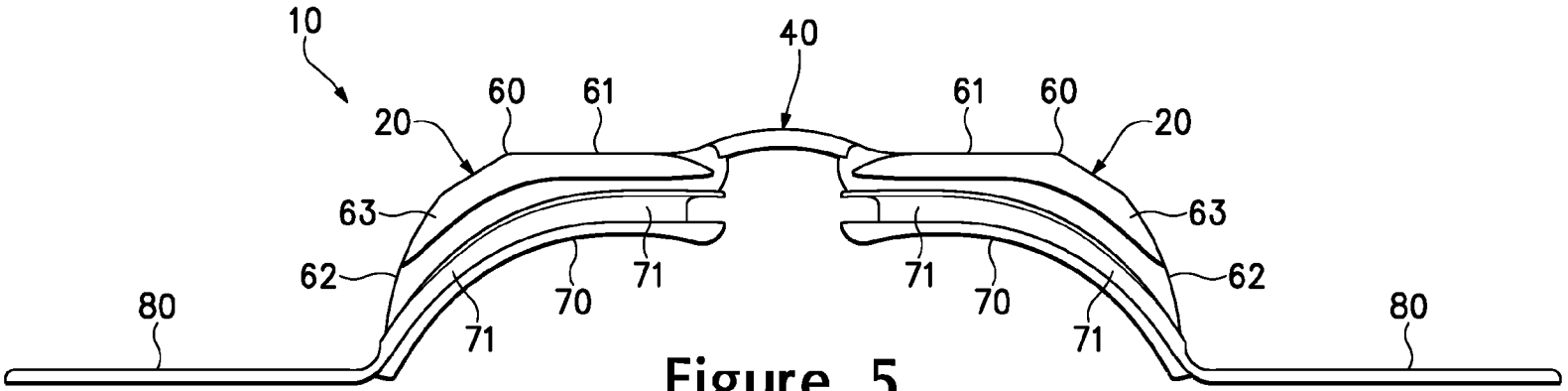
FIG. 5 is a bottom plan view of the aquatic goggles.
Figure 7:
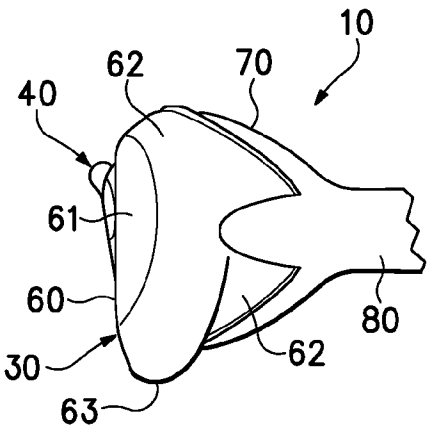
FIGS. 6 and 7 are side elevational views of the aquatic goggles.
Figure 6:
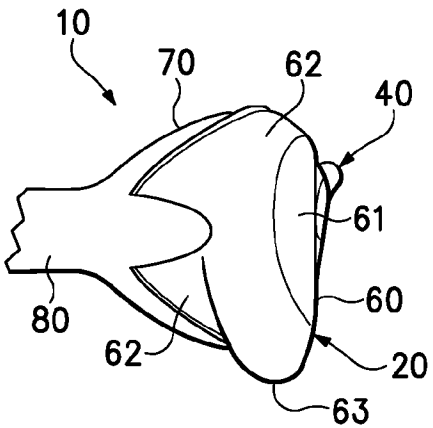

The following discussion and accompanying figures disclose various configurations of a pair of aquatic goggles 10 that may be utilized during swimming (e.g., recreational or competitive swimming) or a variety of other aquatic activities. In addition to providing protection for eyes of a swimmer, goggles 10 isolate the eyes from surrounding water and improve underwater vision.

Goggles Configuration

Referring to FIGS. 1-7, goggles 10 are depicted as having a pair of eyepieces 20 and 30, a nosebridge 40, and a headstrap 50. When worn by a swimmer, eyepieces 20 and 30 extend over the eyes and contact the face to provide the swimmer with an eye-air interface, rather than exposing the eyes directly to the water. Additionally, nosebridge 40 extends over a nose of the swimmer, and headstrap 50 extends around a head of the swimmer. In this manner, goggles 10 are secured to the head such that eyepieces 20 and 30 cover the eyes and prevent water from contacting the eyes during swimming or other aquatic activities.

Eyepieces 20 and 30 each have a generally concave and contoured configuration. The concave aspect of eyepieces 20 and 30 effectively forms an area that traps air to impart the eye-air interface when the head is immersed in water. Additionally, the contoured configuration effectively follows the contour of the face to form a seal between the face (i.e., portions of the face surrounding the eyes) and eyepieces 20 and 30, thereby preventing water from entering eyepieces 20 and 30 and obstructing vision. Eyepieces 20 and 30 are substantially identical to each other, but have mirror-image configurations that respectively correspond with a right eye and a left eye of the swimmer. That is, eyepiece 20 is intended to cover the right eye, whereas eyepiece 30 is intended to cover the left eye. For purposes of the following material, eyepiece 20 will be primarily discussed with an understanding that eyepiece 30 incorporates substantially similar features and elements that are identified with identical reference numerals.

Eyepiece 20 includes a lens 60, a gasket 70, and an extension member 80. Lens 60 is generally transparent and has a front portion 61 and a peripheral portion 62 that extends around front portion 61 to define the generally concave configuration discussed above. Whereas front portion 61 provides an area through which the swimmer sees when wearing goggles 10, peripheral portion 62 extends rearward and defines an edge for securing gasket 70. A thickness of front portion 61 is depicted as being substantially uniform in the cross-sections of FIGS. 8A-8C, but front portion 61 may have a varying thickness that refracts light to correct myopia, hyperopia, or astigmatism, for example. Suitable materials for lens 60 include a variety of polymer materials (e.g., polycarbonate), glass, or combinations of polymer materials and glass. Although formed from a generally transparent material, lens 60 may be colored or may incorporate a coating (e.g., a mirrored coating) to reduce glare or enhance aesthetic properties of goggles 10.

Lens 60 also defines a fairing 63 that extends outward and downward from front portion 61 and peripheral portion 62. Fairing 63 has the configuration of a flange that is generally co-planar with areas of front portion 61 and is spaced from the edge of peripheral portion 62 that joins with gasket 70. Eyepiece 20 generally includes an inner area that is positioned proximal to the side where nosebridge 40 is joined, and eyepiece 20 generally includes an outer area that is positioned opposite the side where nosebridge 40 is joined. Although the position of fairing 63 may vary significantly, a majority of fairing 63 is depicted as being located within the outer area. That is, a majority of fairing 63 is located in an area of eyepiece 20 that is positioned away from nosebridge 40.

An advantage of fairing 63 relates to the hydrodynamic properties of goggles 10. More particularly, fairing 63 reduces drag upon goggles 10 as water passes over goggles 10 during swimming. Positioning fairing 63 within the outer area (i.e., away from nosebridge 40) provides lesser drag than a centrally-located fairing or a fairing that is positioned relatively close to nosebridge 40. That is, the overall drag upon goggles 10 may be reduced when fairing 63 is positioned within the outer area. Accordingly, the presence of fairing 63 and the location of fairing 63 effectively reduce the overall drag upon goggles 10.

Gasket 70 is secured to an edge of peripheral portion 62 and extends around lens 60 to form a seal between the face and eyepiece 20, thereby preventing water from entering eyepiece 20 and obstructing vision. Given that gasket 70 forms a seal, gasket 70 effectively traps air within eyepiece 20 to provide the eye-air interface when swimming. Whereas the material forming lens 60 may be relatively rigid, a material forming gasket 70 may be more compliant to permit gasket 70 to flex, compress, stretch, or otherwise deform when forming the seal that prevents water from entering eyepiece 20. As such, suitable materials for gasket 70 include various polymer materials, such as rubber, silicone, and polyurethane, for example. Gasket 70 may be absent in some configurations of goggles 10.

Figure 8A:
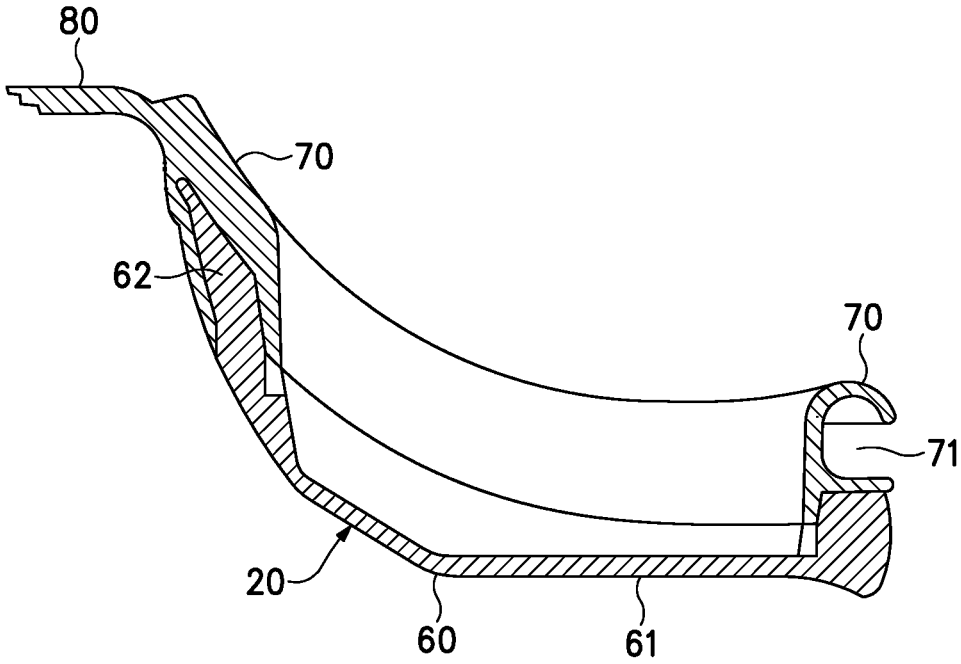
FIGS. 8A-8C are cross-sectional views of the aquatic goggles, as defined by section lines 8A-8C in FIG. 3.
Figure 8B:
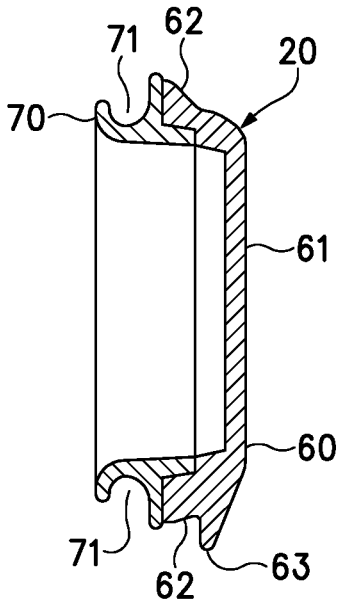
Figure 8C:
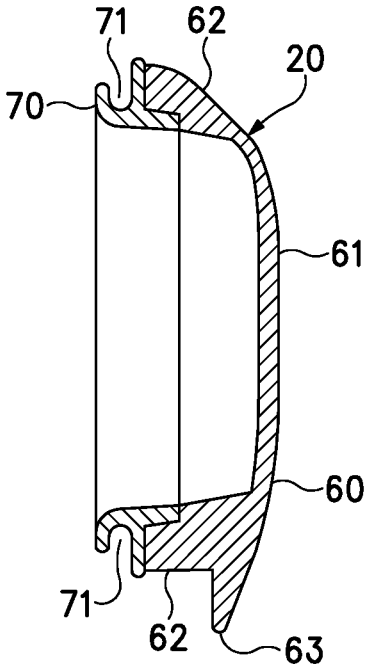

An indentation 71 extends at least partially around gasket 70. In order to impart greater flex or deformation adjacent to nosebridge 40 (i.e., in the inner area of eyepiece 20), indentation 71 has greater width and depth adjacent to nosebridge 40 than in other areas of eyepiece 20. A horizontal cross-section through eyepiece 20 is depicted in FIG. 8A, whereas a pair of vertical cross-sections are depicted in FIGS. 8B and 8C. In comparing the cross-sections, the width and depth of indentation 71 varies around eyepiece 20. More particularly, the width and depth of indentation 71 is greater adjacent to nosebridge 40 (see FIG. 8A) than in upper and lower areas of eyepiece 20 (see FIGS. 8B and 8C. Furthermore, indentation 71 may be absent from the side of eyepiece 20 positioned away from nosebridge 40 (i.e., in the outer area of eyepiece 20). Although both the width and the depth of indentation 71 vary around eyepiece 20, only one of the width or the depth may vary in some configurations of gasket 70. An advantage of having the decreasing width and depth in indentation 71 is that the drag upon goggles 10 may be lessened by decreasing the overall thickness of goggles 10.

Extension member 80 extends outward from lens 60 and forms a strap connection point 81 at which headstrap 50 is joined to eyepiece 20. Although extension member 80 is depicted as being formed of unitary (i.e., one-piece) construction with gasket 70, extension member 80 may be a separate element that is joined to lens 60 or another portion of eyepiece 20. Given that extension member 80 may be formed of unitary construction with gasket 70, any of the various materials discussed above for gasket 70 may also be utilized for extension member 80. In some configurations, gasket 70 and extension member 80 may be formed of unitary construction, but formed from different polymer materials.

As with fairing 63, an advantage of extension member 80 relates to the hydrodynamic properties of goggles 10. More particularly, extension member 80 reduces drag upon goggles 10 as water passes over goggles 10 during swimming. Extension member 80 has a generally flat or planar configuration and spaces the area at which headstrap 50 joins with eyepiece 20 from lens 60. When goggles 10 are worn by a swimmer, eyepiece 20 extends over the right eye and extension member 80 extends rearwardly. During competitions, for example, a swimmer may wear a swim cap, which is a relatively tightly-fitting silicone or rubber cap that reduces drag. Given that extension member 80 extends rearwardly, the area of extension member 80 forming strap connection point 81 may be located under the swim cap. That is, the area at which headstrap 50 joins with eyepiece 20 may be located under the swim cap. Depending upon the manner in which a conventional headstrap is joined with a conventional eyepiece, the connection may form a drag-inducing area of the aquatic goggles. By locating strap connection point 81 in an area that is covered by the swim cap, the overall drag upon goggles 10 is effectively reduced. Moreover, by forming extension member 80 to have the generally flat or planar configuration that lays against the head of the swimmer, the overall drag upon goggles 10 is further reduced. Accordingly, extension member 80 spaces strap connection point 81 from eyepiece 20 in order to reduce drag.

A distance along extension member 80 and between lens 60 and strap connection point 81 may vary significantly, but generally has a length sufficient to locate strap connection point 81 in an area that is covered by a swim cap. As an example, a distance of at least three centimeters may locate strap connection point 81 in an area that is generally covered by a swim cap, such that the distance may range from three to ten centimeters or more. In some configurations of goggles 10, the distance may be at least two centimeters or may be at least five centimeters. In the configuration depicted in FIGS. 1-7, however, the distance along extension member 80 and between lens 60 and strap connection point 81 is represented as being approximately four and a half centimeters.

Strap connection point 81 is depicted as being an aperture extending through extension member 80, but may also be a clip, retainer, or other device that effectively secures headstrap 50 to eyepiece 20. When goggles 10 are worn by the swimmer, headstrap 50 is generally placed in tension and stretches to tightly-fit around the head of the swimmer. The tension in headstrap 50 also induces tension in extension member 80. Although extension member 80 may be formed from a variety of materials, as noted above, an advantage of forming extension member 80 from polyurethane is that extension member 80 exhibits relatively little stretch when placed in tension by headstrap 50.

Nosebridge 40 is joined to a side of each of eyepieces 20 and 30 and extends between eyepieces 20 and 30 to space eyepieces 20 and 30 from each other. In order to join nosebridge 40 to eyepiece 20, lens 60 defines an indented area in which an end of nosebridge 40 is secured through adhesive or thermobonding, for example. A similar configuration is utilized for eyepiece 30. Although the relative height of nosebridge 40 may vary, nosebridge 40 is depicted as being raised above a central area of eyepieces 20 and 30, thereby decreasing the probability that nosebridge 40 will contact or press upon the nose of the swimmer when goggles 10 are worn. Additionally, raising nosebridge 40 permits nosebridge 40 to be located inward and more toward the face of the swimmer, thereby reducing drag. Although the configuration of nosebridge 40 discussed above provides a suitable structure for goggles 10, a variety of other conventional nosebridge structures may be utilized. Additionally, goggles 10 or nosebridge 40 may incorporate an adjustment system that permits the swimmer to change a distance in the spacing between eyepieces 20 and 30.

Headstrap 50 extends around a head of the swimmer and is generally formed from an elastomer material that stretches to hold goggles 10 against the head. As discussed above, headstrap 50 extends through strap connection point 81 to join headstrap 50 to eyepiece 20. Although headstrap 50 is depicted as having a looped configuration wherein two overlapped segments extend around the head, headstrap 50 may have a configuration wherein only a single segment extends around the head. Although either of these configurations are suitable for headstrap 50, a variety of other conventional headstrap configurations may also be utilized.

Manufacturing Method

Figure 9:
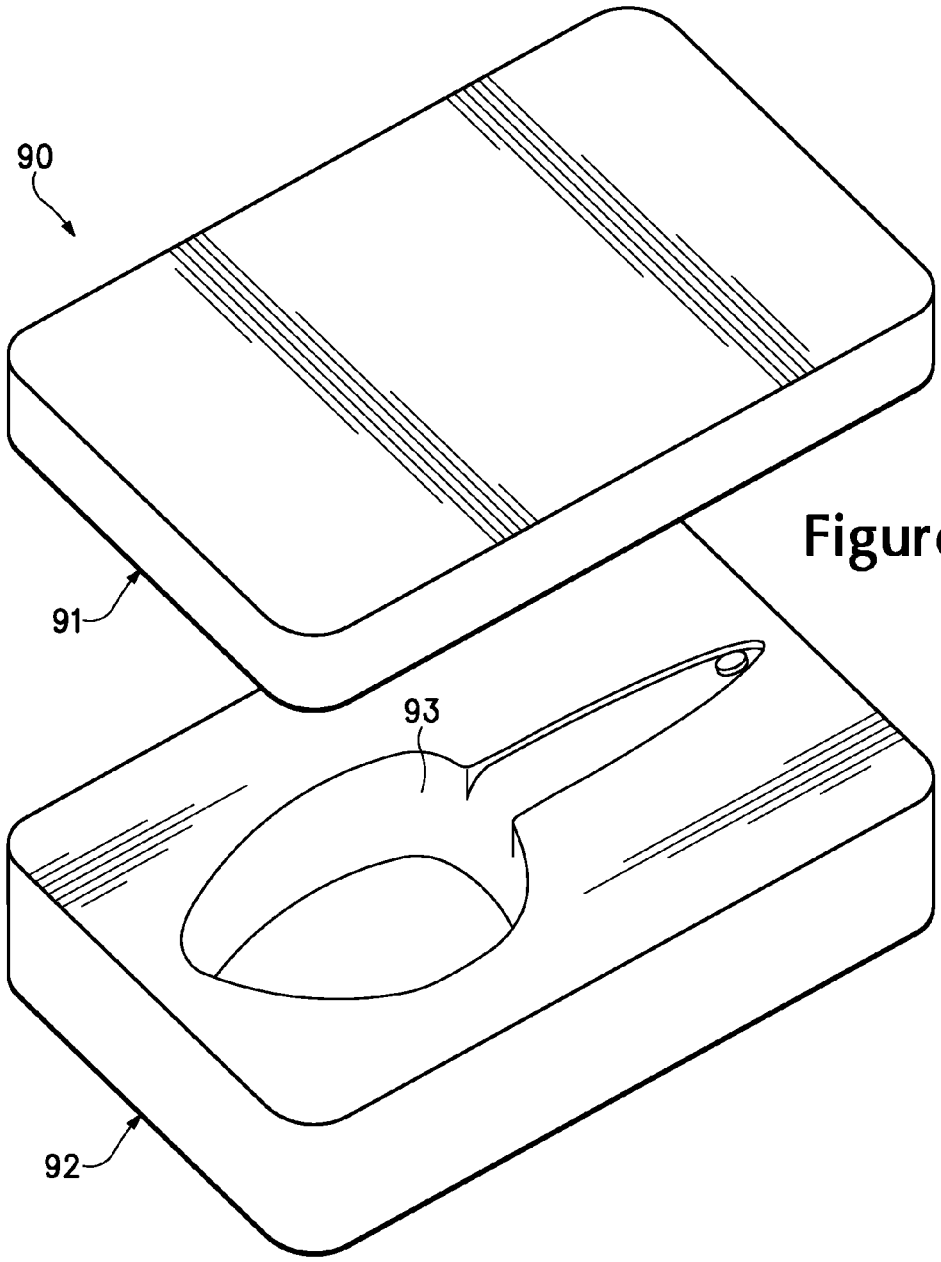
FIG. 9 is a perspective view of a mold for manufacturing an eyepiece of the aquatic goggles.

Although a variety of manufacturing processes may be utilized to form goggles 10, an example of a suitable molding and assembly process will now be discussed. With reference to FIG. 9, a mold 90 that may be utilized in a molding process for eyepiece 20 is depicted as including a first mold portion 91 and a second mold portion 92. Mold portions 91 and 92 each cooperatively form a cavity 93 with the approximate shape and dimensions of eyepiece 20. That is, cavity 93 has the shape and the dimensions of the combination of lens 60, gasket 70, and extension member 80. As discussed in greater detail below, mold 90 is utilized to form eyepiece 20 from a pre-formed lens 60 and polymer material that (a) bonds with lens 60 and (b) molds to form gasket 70 and extension member 80.

Figure 10A:
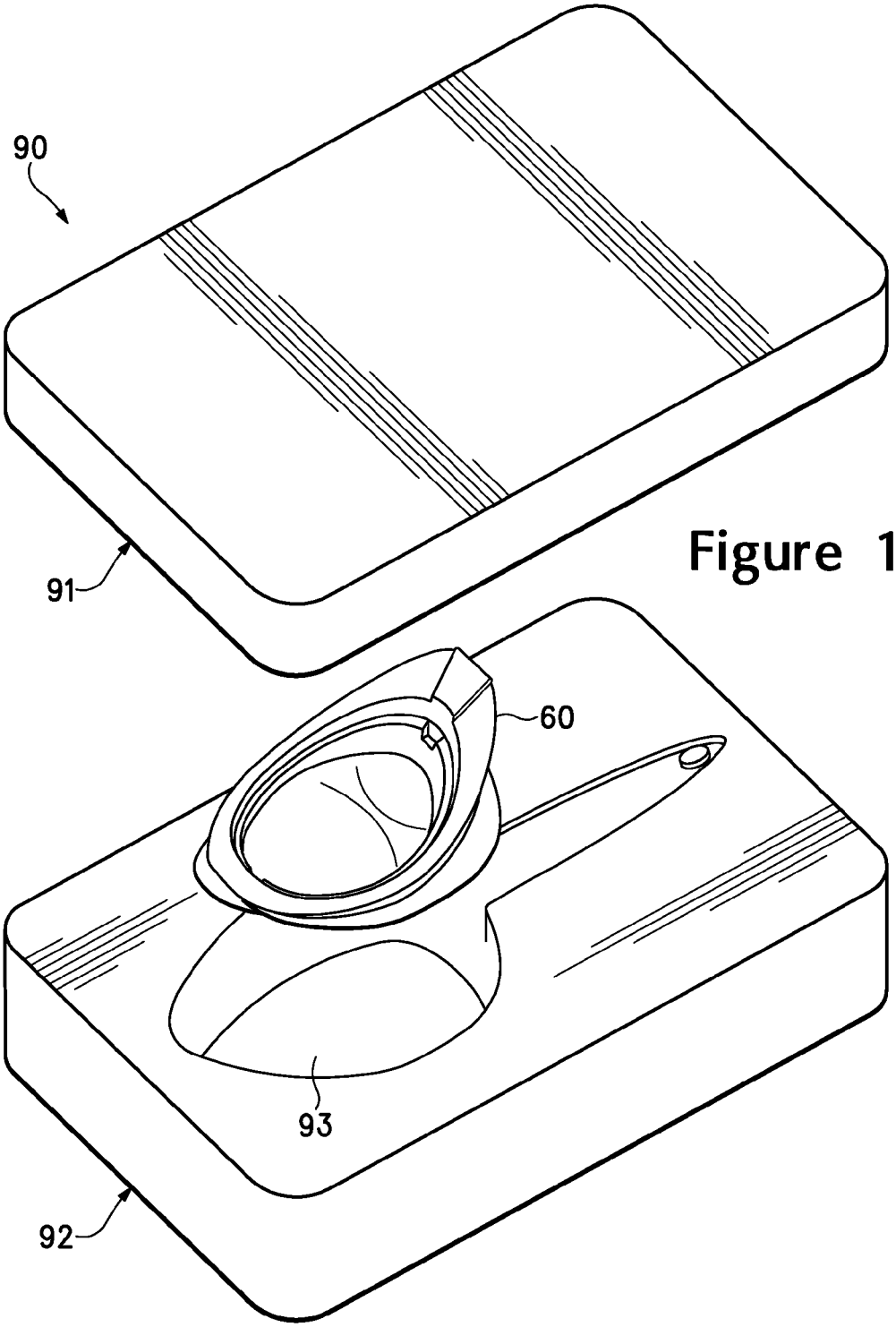
FIGS. 10A-10E are a perspective views of a manufacturing process for the aquatic goggles.
Figure 10B:
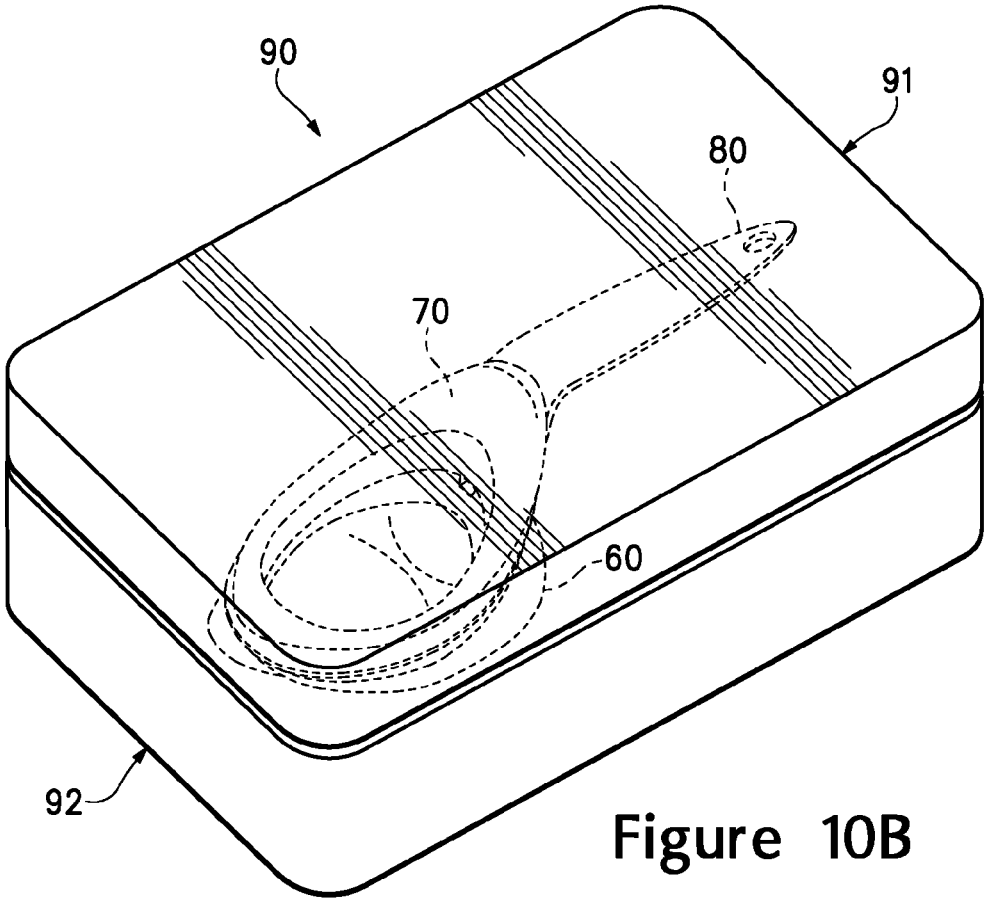
Figure 10C:
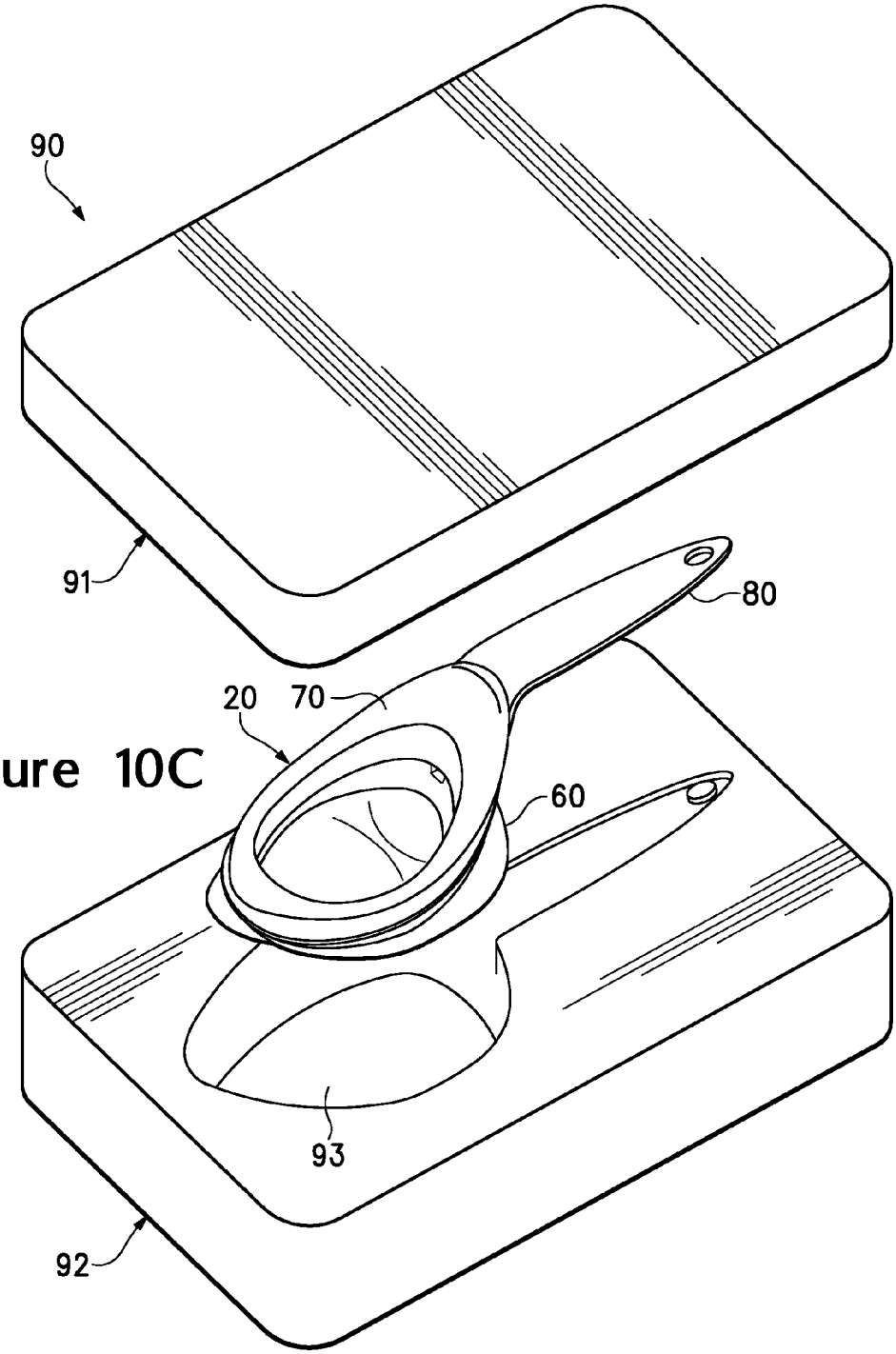
Figure 10D:
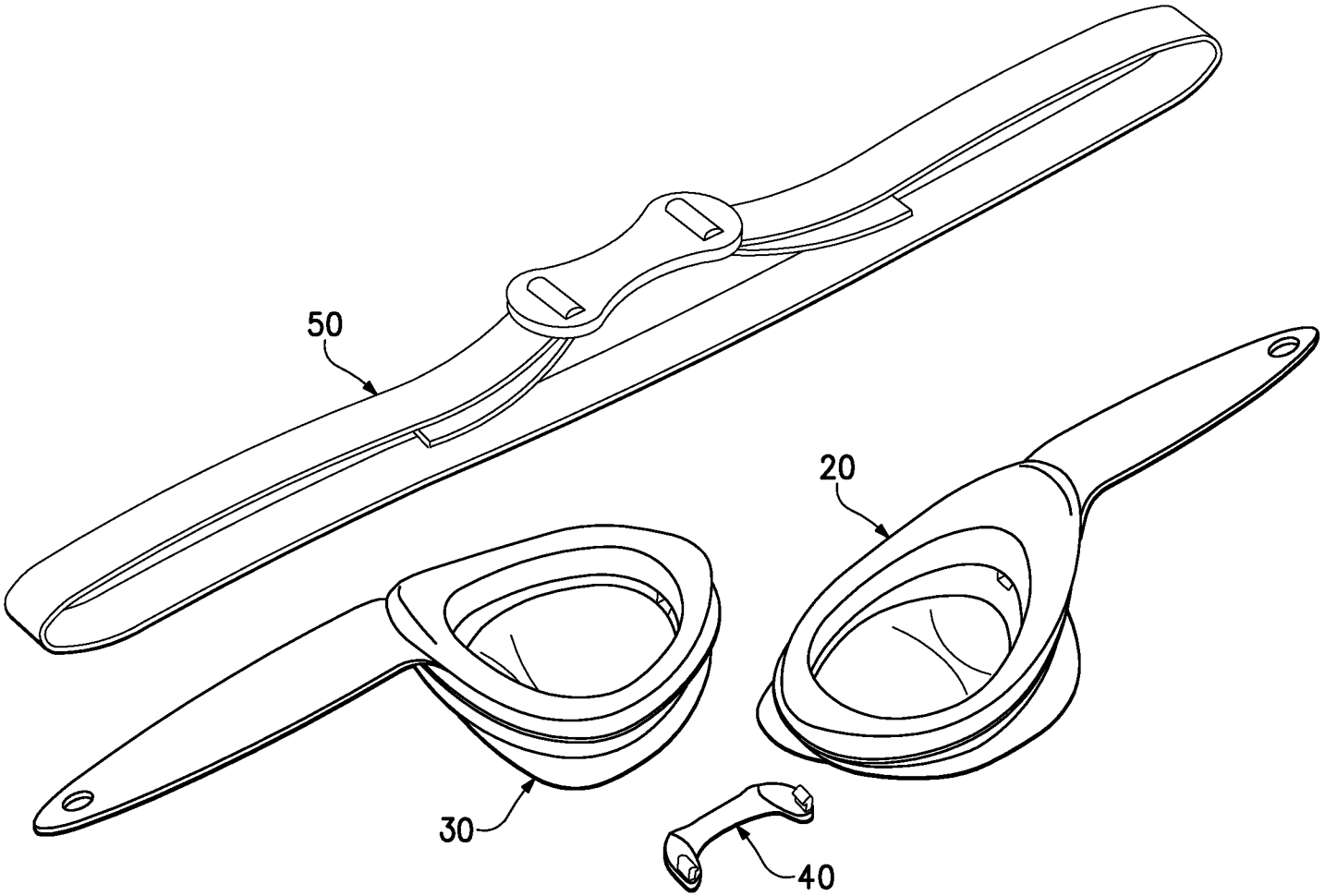
Figure 10E:
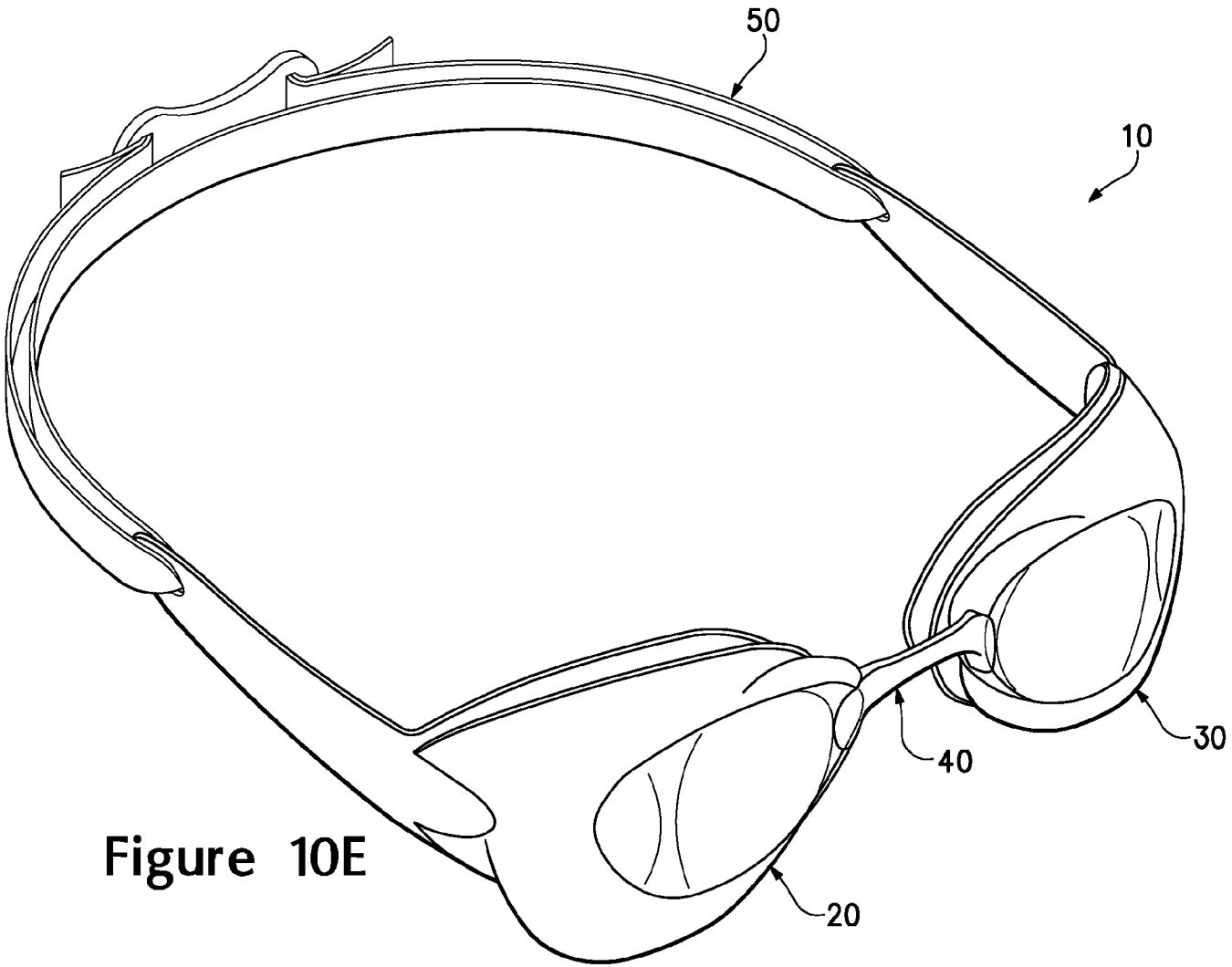

In manufacturing eyepiece 20, a lens 60 is located between mold portions 91 and 92, as depicted in FIG. 10A. Once positioned, mold portions 91 and 92 translate toward each other such that lens 60 enters cavity 93, as depicted in FIG. 10B. As noted above, cavity 93 has the approximate shape and dimensions of eyepiece 20. Accordingly, lens 60 may be located within cavity 93 in a position that corresponds with the position of lens 60 in eyepiece 20. Following the closing of mold 90, a resinous or uncured polymer material is injected into cavity 93 and into the area corresponding with gasket 70 and extension member 80. Given that cavity 93 has the approximate shape of eyepiece 20, the polymer material effectively molds to the shape of gasket 70 and extension member 80. More particularly, gasket 70 and extension member 80 are formed of unitary construction from the polymer material, and features such as indentation 71, the planar configuration of extension member 80, and an aperture corresponding with strap connection point 81 are formed from the polymer material. The polymer material may also bond with lens 60 to effectively secure gasket 70 to lens 60. Once the polymer material has at least partially cured, mold portions 91 and 92 may separate such that eyepiece 20 may be removed from cavity 93, as depicted in FIG. 10C. Following the manufacture of eyepiece 20, other elements of goggles 10 may be brought together, as depicted in FIG. 10D. Nosebridge 40 and headstrap 50 may then be joined to each of eyepieces 20 and 30, as depicted in FIG. 10E, to substantially complete the manufacture of goggles 10.

Although the manufacturing process discussed above provides a suitable method of manufacturing goggles 10, a variety of other methods may also be utilized. As an example, mold 90 may incorporate a pair of cavities 93 that simultaneously form both of eyepieces 20 and 30. In some manufacturing processes, gasket 70 and extension member 80 may be formed as separate elements, rather than elements formed of unitary construction. Additionally, gasket 70 and extension member 80 may be formed separate from lens 60 and subsequently joined with lens 60 (e.g., with an adhesive or heat-bonding). In some configurations of goggles 10, eyepieces 20 and 30, nosebridge 40, and headstrap 50 may be provided to the swimmer in an unassembled state, with the swimmer performing the final steps of assembly according to the preferences of the swimmer. Accordingly, the specific method of manufacturing goggles 10 may vary significantly.

Further Goggles Configurations

Figure 11A:
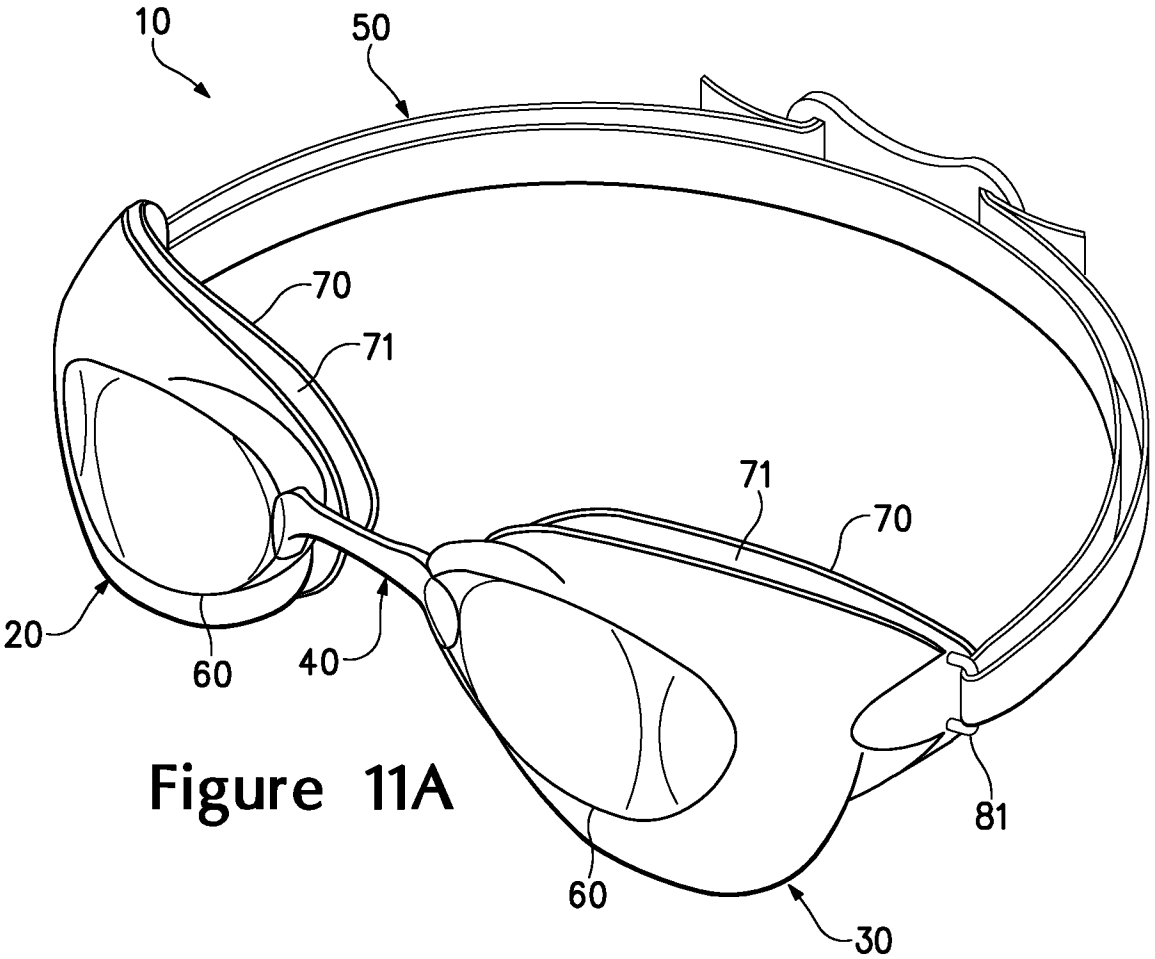
FIGS. 11A-11C are perspective views of additional configurations of the aquatic goggles.
Figure 11B:
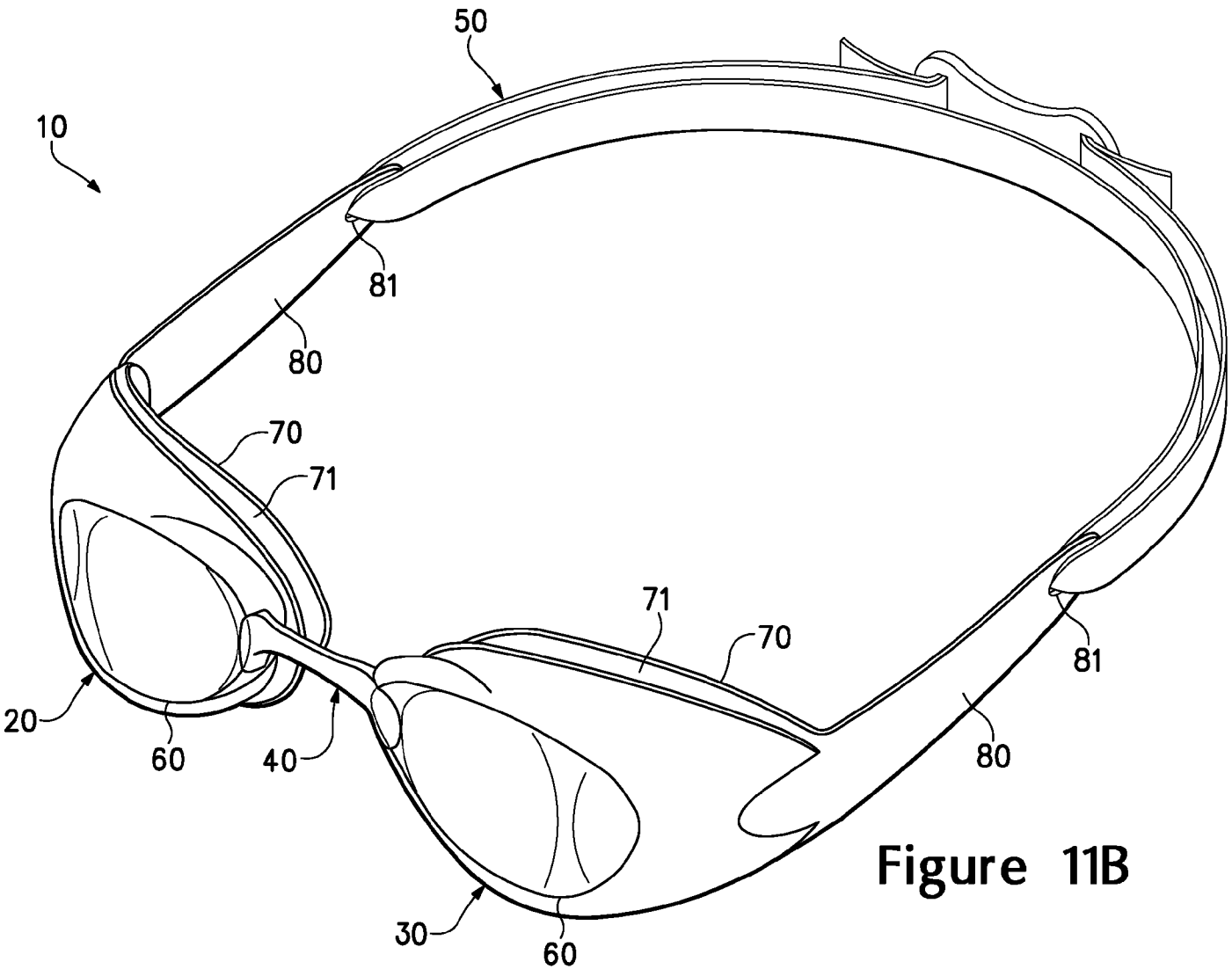

Based upon the above discussion, goggles 10 incorporate a variety of features that enhance the hydrodynamic properties or fit of goggles 10. More particularly, the presence of fairing 63 and extension member 80 effectively reduce drag upon goggles 10 as the swimmer passes through the water, and the presence of indentation 71 enhances the fit and decreases drag of goggles 10. Although all of these features may be incorporated into goggles 10, some goggle configurations may only incorporate one or more of these features. Referring to FIG. 11A, for example, extension member 80 is absent from eyepiece 20 such that headstrap 50 is joined at a location proximal to lens 60, and indentation 71 is depicted as having a substantially constant width and depth. As another example, fairing 63 is absent in the configuration of FIG. 11B. Accordingly, each of these features may be independently incorporated into aquatic goggles in order to enhance the hydrodynamic properties or fit.

Figure 11C:
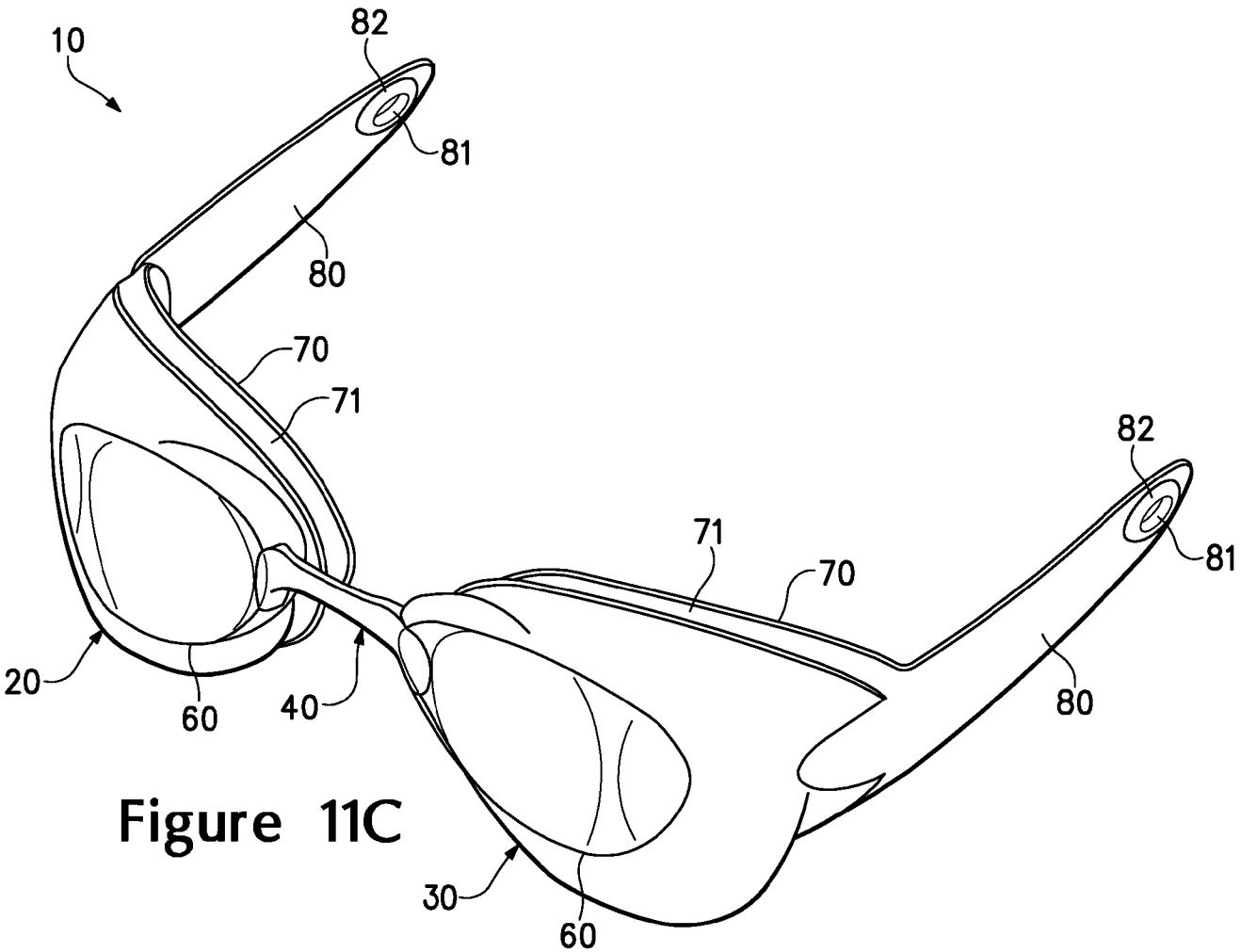
Figure 12:
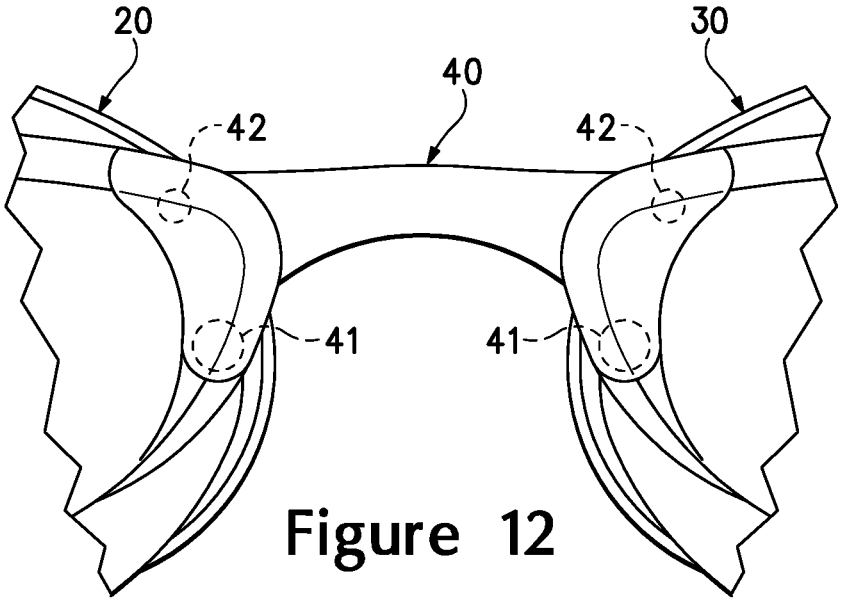
FIG. 12 is a front elevational view of a portion of the aquatic goggles.
Figure 13:
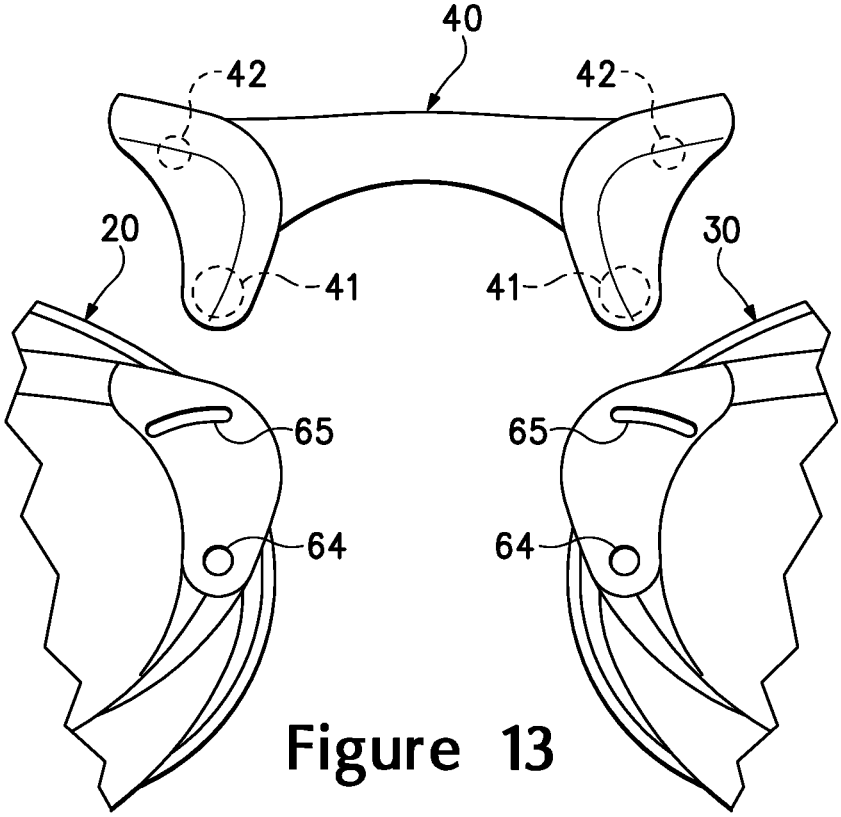
FIG. 13 is an exploded front elevational view of the portion of the aquatic goggles.
Figure 14:
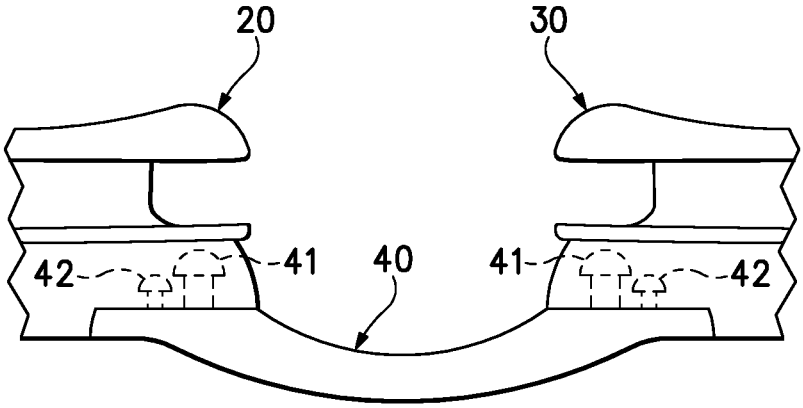
FIG. 14 is a top plan view of the portion of the aquatic goggles.
Figure 15:
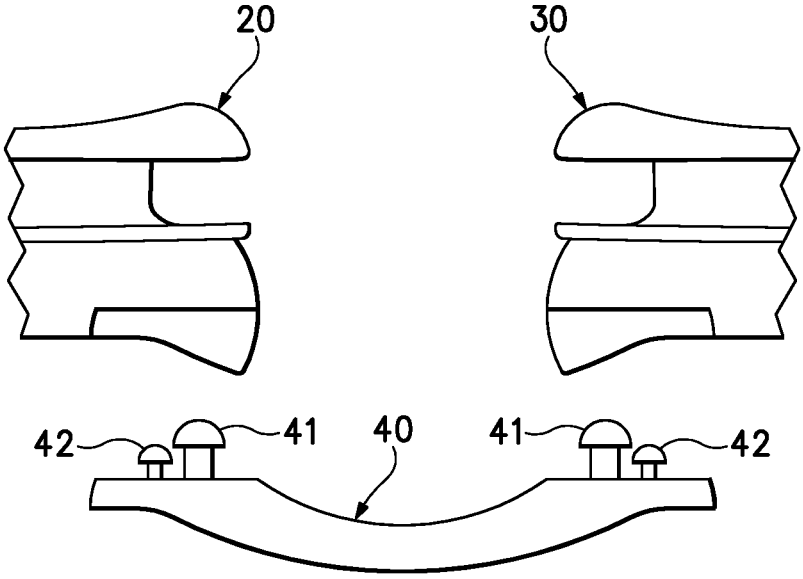
FIG. 15 is an exploded top plan view of the portion of the aquatic goggles.

In some configurations of goggles 10, extension member 80 may incorporate an insert 82, as depicted in FIG. 11C. When headstrap 50 is placed in tension, thereby inducing tension in extension member 80, the aperture forming strap connection point 81 may expand or otherwise stretch. In order to reinforce strap connection point 81, insert 82 may be located within strap connection point 81 and formed of a material that is more rigid or less stretchable than the material forming extension member 80. In the configuration of FIG. 11C, indentation 71 is also depicted as having a substantially constant width and depth.

Further variations in goggles 10 may relate to nosebridge 40. As an example, a connection system that may be utilized to join nosebridge 40 to eyepieces 20 and 30 is depicted in FIGS. 12-15. In order to join nosebridge 40 to eyepiece 20, lens 60 defines a connection area that includes an aperture 64 and a slot 65. Lens 60 of eyepiece 30 also defines a connection area that includes an aperture 64 and a slot 65. Correspondingly, nosebridge 40 forms a pair of protrusions 41 that extend into apertures 64, and nosebridge 40 forms another pair of protrusions 42 that extends into slots 65. Each of protrusions 41 and 42 have flared end areas that are slightly larger than the diameters of apertures 64 and the widths of slots 65 to ensure that protrusions 41 and 42 remain positioned within apertures 64 and slots 65.

The locations of apertures 64 and slots 65 have an effect upon the relative height of nosebridge 40. As depicted, apertures 64 are located in central areas of lenses 60 (i.e., approximately centered between upper edges and lower edges of lenses 60), and slots 65 are offset upward from the central areas. In this configuration, nosebridge 40 is raised above the central areas, thereby decreasing the probability that nosebridge 40 will contact or press upon the nose of the swimmer when goggles 10 are worn.

The connection system between nosebridge 40 and eyepieces 20 and 30 permits rotational movement between nosebridge 40 and eyepieces 20 and 30, thereby enhancing the fit of goggles 10. More particularly, protrusions 41 may rotate within apertures 64, and protrusions 42 may slide along slots 65 to impart the rotational movement between nosebridge 40 and eyepieces 20 and 30. The degree to which nosebridge 40 and eyepieces 20 and 30 may rotate at least partially depends upon the lengths of slots 65. That is, as slots 65 increase in length, the rotational movement between nosebridge 40 and eyepieces 20 and 30 generally increases. Given that both eyepieces 20 and 30 are joined to nosebridge 40 in this manner, each of eyepieces 20 and 30 may rotate to properly fit goggles 10 to the swimmer. Although the connection system discussed above provides a suitable structure for joining nosebridge 40 to each of eyepieces 20 and 30, a variety of other conventional nosebridge structures may be utilized. Additionally, goggles 10 may incorporate an adjustment system that permits the swimmer to change a distance in the spacing between eyepieces 20 and 30.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. Aquatic goggles comprising:

a pair of eyepieces, at least one of the eyepieces including a lens formed from a first material, a gasket extending around the lens, and an extension member extending outward from the lens, the extension member defining a strap connection point, a distance along the extension member and between the lens and the strap connection point being at least three centimeters;

a nosebridge extending between the eyepieces; and a headstrap secured to the strap connection point, wherein the gasket and the extension member are formed from a second material and are formed of unitary construction, and wherein the lens defines an aperture and an elongate slot, and the nosebridge defines a first protrusion and a second protrusion, the first protrusion being located within the aperture, and the second protrusion being located within the slot.

2. The aquatic goggles recited in claim 1, wherein the gasket and the extension member are formed from a polyurethane material.

3. The aquatic goggles recited in claim 1, wherein the extension member has a planar configuration.

4. The aquatic goggles recited in claim 1, wherein the strap connection point is an aperture extending through the extension member.

5. The aquatic goggles recited in claim 4, wherein an insert is located within the aperture of the extension member, and the insert is formed from a material that is more rigid than a material of the extension member.

6. The aquatic goggles recited in claim 1, wherein the lens includes a front portion and a peripheral portion extending around the front portion to define a concave configuration in the lens, the gasket being secured to an edge of the peripheral portion, and the lens including a fairing extending outward from the front portion and the peripheral portion, the fairing being spaced from the edge of the peripheral portion.

7. The aquatic goggles recited in claim 1, wherein the aperture is located in a central area of the lens, and the slot is offset from the central area.

8. The aquatic goggles recited in claim 1, wherein the gasket defines an indentation extending around at least a portion of the lens, the indentation having a first depth in an area of the gasket that is adjacent to the nosebridge, and the indentation having a second depth in an area of the gasket that is adjacent to the extension member, the first depth being greater than the second depth.

9. Aquatic goggles comprising:

a first eyepiece and a second eyepiece, at least the first eyepiece having a lens formed from an at least partially transparent material, the lens including a front portion and a peripheral portion extending entirely around the front portion to define a concave configuration in the lens, the peripheral portion extending in a rearward direction relative to the front portion to define a peripheral edge located opposite the front portion, and the lens including a fairing that extends outward from the front portion and the peripheral portion, the fairing being entirely spaced from the peripheral edge, the first eyepiece having an inner area positioned adjacent to a nose of a wearer when the aquatic goggles are worn, and the first eyepiece having an outer area positioned away from the nose of the wearer when the aquatic goggles are worn, a majority of the fairing being located within the outer area;

a nosebridge extending between the first eyepiece and the second eyepiece, the nosebridge being secured to the inner area of the first eyepiece and also secured to the second eyepiece; and a headstrap formed from an elastic material, the headstrap being secured to the outer area of the first eyepiece and also secured to the second eyepiece.

10. The aquatic goggles recited in claim 9, wherein a gasket extends around the lens, the gasket being formed from a material with greater flexibility than a material of the lens.

11. The aquatic goggles recited in claim 10, wherein the gasket defines an indentation extending around at least a portion of the lens, the indentation having a first width in the inner area, and the indentation having a second width in the outer area, the first width being greater than the second width.

12. The aquatic goggles recited in claim 9, wherein a gasket extends around the lens and an extension member extends outward from the lens, the extension member defining a strap connection point for securing the headstrap to the outer area of the first eyepiece, a distance along the extension member and between the lens and the strap connection point being at least three centimeters.

13. The aquatic goggles recited in claim 12, wherein the gasket and the extension member are formed of unitary construction.

14. The aquatic goggles recited in claim 12, wherein the gasket and the extension member are formed from a polyurethane material.

15. The aquatic goggles recited in claim 12, wherein the extension member has a planar configuration.

16. The aquatic goggles recited in claim 9, wherein the lens defines an aperture and an elongate slot, and the nosebridge defines a first protrusion and a second protrusion, the first protrusion being located within the aperture, and the second protrusion being located within the slot.

17. The aquatic goggles recited in claim 16, wherein the aperture is located in a central area of the lens, and the slot is offset from the central area.

18. The aquatic goggles recited in claim 9, wherein the fairing (a) extends outward and downward from the front portion and the peripheral portion and (b) has a configuration of a flange that is entirely spaced from the peripheral edge.

19. Aquatic goggles comprising:

a first eyepiece having a first connection area that defines a first aperture and a first elongate slot;

a second eyepiece having a second connection area that defines a second aperture and a second elongate slot;

a nosebridge extending between the first eyepiece and the second eyepiece and joined with the first connection area and the second connection area, the nosebridge defining a pair of first protrusions and a pair of second protrusions located on opposite sides of the nosebridge, the first protrusions respectively extending into the first aperture and the first elongate slot, the second protrusions respectively extending into the second aperture and the second elongate slot, and the first protrusions and second protrusions extending in a rearward direction relative to front portions of the first eyepiece and the second eyepiece; and a headstrap secured to the first eyepiece opposite the first connection area and secured to the second eyepiece opposite the second connection area.

20. The aquatic goggles recited in claim 19, wherein the first aperture is located in a central area of the first eyepiece and the first slot is offset from the central area of the first eyepiece.

21. The aquatic goggles recited in claim 19, wherein the first eyepiece includes a lens, a gasket extending around the lens, and an extension member extending outward from the lens, the extension member defining a headstrap connection point, a distance along the extension member and between the lens and the headstrap connection point being at least three centimeters.

22. The aquatic goggles recited in claim 21, wherein the gasket and the extension member are formed of unitary construction.

23. The aquatic goggles recited in claim 22, wherein the gasket and the extension member are formed from a polyurethane material.

24. The aquatic goggles recited in claim 21, wherein the extension member has a planar configuration.

25. The aquatic goggles recited in claim 21, wherein the strap connection point is an aperture extending through the extension member.

26. The aquatic goggles recited in claim 21, wherein the lens includes a front portion and a peripheral portion extending around the front portion to define a concave configuration in the lens, the gasket being secured to an edge of the peripheral portion, and the lens including a fairing extending outward from the front portion and the peripheral portion, the fairing being spaced from the edge of the peripheral portion.

27. The aquatic goggles recited in claim 21, wherein the gasket defines an indentation extending around at least a portion of the lens, the indentation having a first depth in an area of the gasket that is adjacent to the nosebridge, and the indentation having a second depth in an area of the gasket that is adjacent to the extension member, the first depth being greater than the second depth.

28. Aquatic goggles comprising:

a pair of eyepieces, at least one of the eyepieces including a lens formed from a first material and a one-piece element formed of unitary construction from a second material, the one-piece element including a gasket extending around the lens and a strap connection point;

a nosebridge extending between the eyepieces; and a headstrap secured to the strap connection point, wherein the lens includes a front portion and a peripheral portion extending entirely around the front portion to define a concave configuration in the lens, the peripheral portion extending rearward to define a peripheral edge located opposite the front portion, the peripheral edge being spaced from the front portion, and the lens including a fairing that extends outward and downward from the front portion and the peripheral portion, the fairing having a configuration of a flange that is spaced from the peripheral edge.

29. The aquatic goggles recited in claim 28, wherein the second material is more flexible than the first material.

30. The aquatic goggles recited in claim 28, wherein the gasket defines an indentation extending around at least a portion of the lens, the indentation having a first width in an area of the eyepiece that is proximal to the nosebridge, and the indentation having a second width in an area of the eyepiece that positioned opposite the nosebridge, the first width begin greater than the second width.

31. The aquatic goggles recited in claim 28, wherein the gasket defines an indentation extending around at least a portion of the lens, the indentation having a first depth in an area of the eyepiece that is proximal to the nosebridge, and the indentation having a second depth in an area of the eyepiece that positioned opposite the nosebridge, the first depth begin greater than the second depth.

* * * * *